US005562272A

United States Patent [19]

McAbee et al.

[11] Patent Number: 5,562,272

[45] Date of Patent: Oct. 8, 1996

[54] SPLICERS FOR AGGREGATE CONSTRUCTION FORMS

[75] Inventors: Nathaniel T. McAbee; Ted E. Carr, both of Leesburg, Fla.

[73] Assignee: American ADA Compliance Corporation, Leesburg, Fla.

[21] Appl. No.: 265,346

[22] Filed: Jun. 24, 1994

[51] Int. Cl.[6] ..... E01C 15/00; E04G 17/00

[52] U.S. Cl. ..... 249/2; 249/6; 249/192; 249/194; 249/210

[58] Field of Search ..... 249/2–7, 40, 45, 249/47, 192, 193, 194, 210, 218, 216

[56] References Cited

U.S. PATENT DOCUMENTS

| | | | |
|---|---|---|---|
| 955,474 | 4/1910 | Ramey et al. | 249/5 |
| 1,129,658 | 2/1915 | Foy | 249/188 |
| 1,316,610 | 9/1919 | Zakharoff | 249/193 |
| 1,939,007 | 12/1933 | Heltzel | 249/3 |
| 2,453,223 | 11/1948 | Henderson | 264/257 |
| 3,066,962 | 12/1962 | Koeler | 249/219.1 |
| 3,136,023 | 6/1964 | Von Drasek | 249/6 |
| 3,288,426 | 11/1966 | Simpson | 249/5 |
| 3,357,673 | 12/1967 | Williams | 249/194 |
| 3,374,984 | 3/1968 | Mueller | 249/216 |
| 3,381,929 | 5/1968 | Bancker | 249/5 |
| 3,434,689 | 3/1969 | Aftreth | 249/193 |
| 3,662,985 | 5/1972 | Parker | 249/194 |
| 3,863,886 | 2/1975 | Carr | 249/216 |
| 3,945,601 | 3/1976 | Rowley | 249/48 |
| 4,029,288 | 6/1977 | Murphy et al. | 249/216 |
| 4,042,205 | 8/1977 | Herrell | 249/189 |
| 4,183,497 | 1/1980 | Tamez | 249/205 |
| 4,291,858 | 9/1981 | NeSmith | 249/216 |
| 4,494,725 | 1/1985 | Sims | 249/2 |
| 4,711,058 | 12/1987 | Patton | 52/101 |
| 4,750,703 | 6/1988 | Gentilcore et al. | 249/6 |
| 5,076,535 | 12/1991 | Vetter | 249/3 |
| 5,156,753 | 10/1992 | Speidel | 249/5 |
| 5,174,083 | 12/1992 | Mussell | 249/5 |
| 5,343,667 | 9/1994 | Peden | 249/5 |

FOREIGN PATENT DOCUMENTS

| | | | |
|---|---|---|---|
| 672546 | 12/1929 | France | 249/4 |
| 2575208 | 6/1986 | France | 249/2 |

*Primary Examiner*—James P. Mackey
*Attorney, Agent, or Firm*—Joseph C. Mason, Jr.

[57] ABSTRACT

Metallic channel members hold forms for making pads, sidewalks, foundations, headwalls, and other structures. In a first embodiment, a channel member of linear configuration has a width that tightly receives abutting forms and has sidewalls of differing heights. In a second embodiment, one of the sidewalls converges toward the other and abuts a form along a line of contact. In additional embodiments, a pair of metallic channels are hingedly interconnected to one another or are fixedly secured to one another at a predetermined angle such as ninety degrees. In the single channel member embodiments, a bottom wall of the channel member may have a transverse bend formed in it to facilitate wheelchair ramp construction, and in the embodiments including a pair of channel members, one member of the pair may be oriented at a predetermined angle such as five degrees relative to the other member of the pair to facilitate the construction of inclined wheelchair ramps. All of the devices are used in construction projects employing concrete, asphalt or other aggregates.

5 Claims, 7 Drawing Sheets

SPLICERS FOR AGGREGATE CONSTRUCTION FORMS

BACKGROUND OF THE INVENTION

1. Field of the Invention

This invention relates, generally, to the art of concrete, asphalt, and other aggregate construction. More particularly, it relates to devices for holding the forms used in such construction.

2. Description of the Prior Art

Concrete construction requires that boards, generally called "forms" in the industry, be joined end to end along the inside and outside borders of the walk, ramp, headwall, pad, or other structure to be formed. Construction projects including asphalt or other aggregates also require the use of such forms in some applications.

The conventional means for joining forms includes the steps of manually aligning a pair of boards in end to end relation to one another and nailing a short board, known as a "scab," to an outside surface thereof; the scab bridges the parting line where the two boards or forms meet. After the concrete or other aggregate has been poured and allowed to cure, the nails are removed so that the scab and the forms can be reused.

There are a number of drawbacks associated with the presently used technique. First of all, the process of nailing a scab into position is time-consuming, as is the process of removing the nails when the aggregate has cured. Moreover, the scabs are quickly destroyed by the repeated nailings, as are the abutting ends of the forms. This wearing out of scabs and forms is now dealt with by frequent discarding of scabs and frequent trimming of the forms, i.e., the ends of the forms are cut off so that the remaining length thereof can be reused; obviously, the forms become shorter with each trimming and they soon become too short for their intended use.

The quick deterioration of wooden scabs and forms led inventors to develop metallic frames that could supplant the use of their wooden counterparts. Although the metallic devices are durable, they have their own set of shortcomings that limit their utility. For example, metallic forms are manufactured in just a few commonly used lengths such as ten feet, twelve feet, and the like. Thus, they have no utility in applications calling for nonstandard lengths. Moreover, such forms are quite heavy, and sometimes contribute to back injuries. Since damage claims often lead to substantial workmen's compensation expenses, many cities and private contractors are reluctant to use metallic frames. Accordingly, light-in-weight wooden forms continue to be the materials of choice, even though they cannot be installed as quickly as metallic forms and even though they do not last as long.

Ramp construction is also problematic. The Americans with Disabilities Act requires that sidewalks include wheelchair ramps at all curbs or other stepped places. That law currently requires that the slope of ramps may not exceed five degrees; where wooden forms and scabs are employed, measurement of such a slope is a time-consuming project.

Another problem in the industry is the need to build sidewalks, curbs, and the like in uniform widths. For example, a city ordinance might require that all sidewalks have a uniform minimum width of four feet and that all curbs have a certain minimum uniform width. The conventional compliance procedure for meeting these requirements is to measure the width of each section of the structure as the forms are placed into position. One obvious shortcoming of this procedure is that mismeasurements will be made and sections of the completed structure will have to be destroyed and rebuilt; another obvious shortcoming is the time-intensive nature of the procedure.

Thus, what is needed is a new way to join forms in end-to-end relation to one another in the absence of scabs. The new way would lengthen the usable lifetime of the forms, would eliminate the wasteful use of scabs, and would shorten the time required to complete a form installation. New ways to provide ramps and to place forms into parallel relation to one another at a fixed predetermined distance are also required.

At the time the present invention was made, however, it was not obvious to those of ordinary skill in this art how these desireable objectives could be obtained, in view of the prior art when considered as a whole.

SUMMARY OF THE INVENTION

The longstanding but heretofore unfulfilled need for a light-in-weight splicing apparatus for joining together forms in the absence of scabs has now been fulfilled. Moreover, the need for a means for providing ramps and for positioning forms in a predetermined parallel relation to one another has also been fulfilled. The new apparatus extends the lifetime of the forms used in concrete and other aggregate construction as well because it eliminates the need to repeatedly introduce and remove nails thereinto and therefrom, respectively.

The novel device includes a channel having an elongate, flat bottom wall and a pair of sidewalls mounted to opposite longitudinal edges of said flat bottom wall along the extent thereof in generally upstanding relation thereto. The channel has a linear configuration, and said pair of sidewalls includes a first sidewall and a second sidewall. The first sidewall has a first height and the second sidewall has a second height less than said first height. The flat bottom wall has a transverse extent substantially equal to a transverse extent of a concrete form, and the channel has a length sufficient to receive therein abutting ends of a pair of forms disposed in end-to-end relation to one another; the length is sufficient to align said pair of forms in axial alignment with one another.

In a first embodiment, the first and second sidewalls are disposed in parallelism to one another, but in another embodiment, said second sidewall is disposed in converging relation to said first sidewall, said second sidewall having a top edge that abuts a form positioned within said channel member along a longitudinally-extending line of contact to reduce the frictional contact between the second sidewall and the form. Still further embodiments include channels disposed at a right angle to one another and channels that are hingedly connected to one another so that they may be disposed in multiple angular orientations. All of the aforesaid embodiments may be ramped to provide slopes that accommodate wheelchairs.

Many cities require that sidewalks have a minimum width, such as four feet. In the past, construction of a sidewalk having the minimum width along its extent has been problematic. Another embodiment of the invention provides a tool where parallel form-holding channels may be positioned at any predetermined distance from one another and locked into such position. The tool includes a rigid telescoping member that interconnects the parallel channels and a locking means for locking the telescoping member into a fixed position; it allows rapid setting, spacing, and aligning of parallel forms for walks, curbs, pads, walls, and the like.

Another embodiment replaces the telescoping interconnecting member with a bent rebar or other rod; the spacing between the interconnected channels is not readily adjustable in such embodiment.

Thus it is seen that a primary object of this invention is to appreciably advance the art of concrete and other aggregate construction.

A closely related object is to reduce the time required to set up an aggregate construction project and to reduce the time required to remove forms from a completed project.

Still further objects are to eliminate the use of scabs, to eliminate the need to cut off the ends of damaged forms, to prolong the useful lifetimes of the forms, to facilitate the construction of wheelchair ramps that comply with laws that govern the wheelchair-accessibility of public places, and to facilitate the construction of elongate structures having uniform widths along their extent.

Another object is to facilitate the use of light-in-weight forms that are less likely to cause back injuries.

These and other important objects, features and advantages of the invention will become apparent as this description proceeds.

The invention accordingly comprises the features of construction, combination of elements and arrangement of parts that will be exemplified in the construction hereinafter set forth, and the scope of the invention will be indicated in the claims.

BRIEF DESCRIPTION OF THE DRAWINGS

For a fuller understanding of the nature and objects of the invention, reference should be made to the following detailed description, taken in connection with the accompanying drawings, in which.

DETAILED DESCRIPTION OF THE PREFERRED EMBODIMENT

Figure 1:
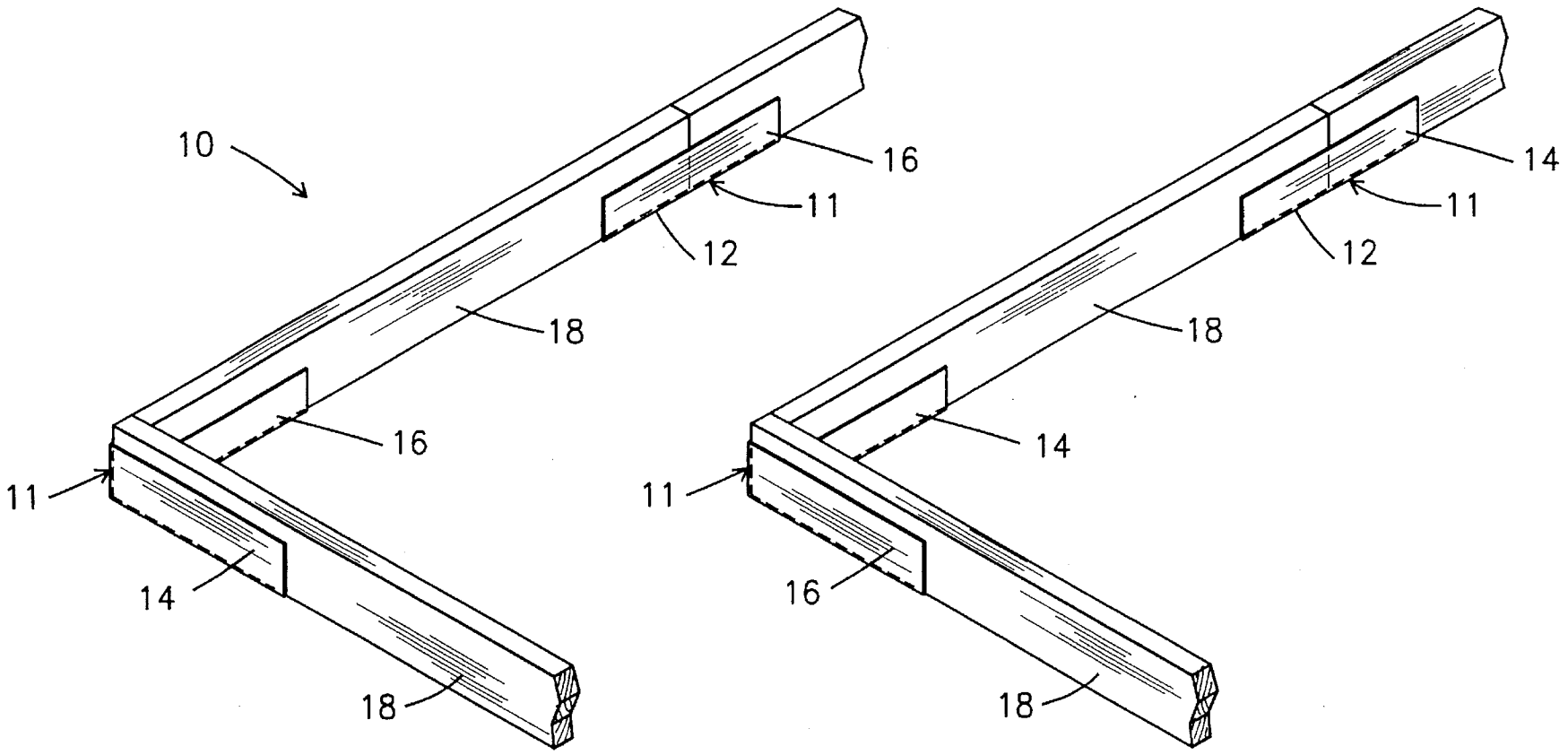
FIG. 1 is a perspective view depicting a typical set up of the novel channels when being used in sidewalk construction.

Referring now to FIG. 1, it will there be seen that an illustrative environment within which the invention has utility is denoted as a whole by the reference numeral 10.

Although numeral 10 denotes a typical sidewalk construction, it should be understood that the novel channels disclosed herein, collectively denoted 11, have utility in the construction of concrete structures other than sidewalks such as patios, swimming pool decks, courtyards, pads, headwalls, curbs, foundations, monolithic slabs, and the like. They also have utility in the construction of structures formed of asphalt or other aggregate.

Figure 3:
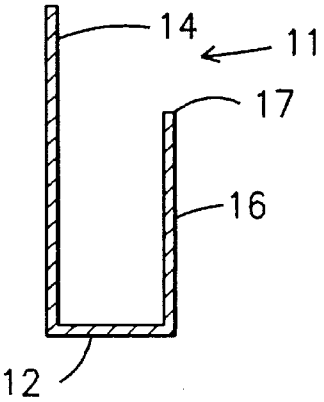
FIG. 3 is a transverse sectional view taken along line 3—3 in FIG. 2.
Figure 2:
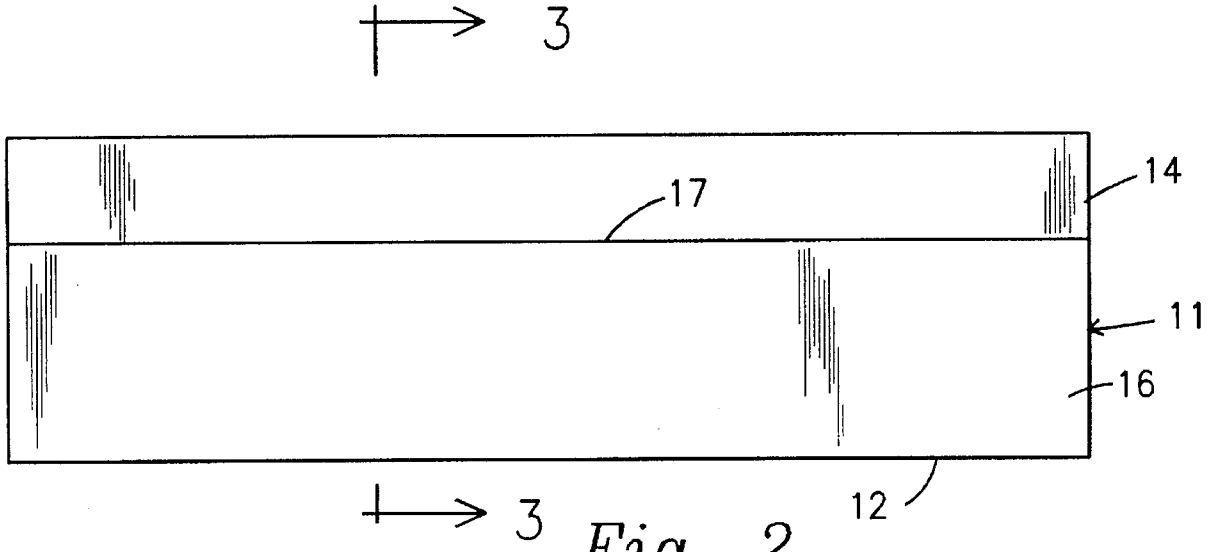
FIG. 2 is a front elevational view of a channel of the first embodiment.

As best understood in connection with FIGS. 2 and 3, each channel 11 includes flat bottom wall 12, first sidewall 14, and second sidewall 16. The sidewalls are mounted along opposite longitudinal edges of said bottom wall in parallelism to one another in this embodiment. Forms, collectively denoted 18, disposed in abutting, end-to-end relation to one another therein, are tightly gripped by the opposing interior sidewall surfaces of said sidewalls 14, 16. Accordingly, it should be understood that channel 11 performs the function of a scab but does not require the use of nails. However, nail holes in various configurations are provided in sidewalls 14 of all embodiments of this invention for use by those who prefer to use nails.

Note that first sidewall 14 has a height that exceeds the height of second sidewall 16. When channel 11 is used in the construction of a sidewalk or other structure, the first sidewall 14 is positioned away from the aggregate. The height of second sidewall 16 is less than the height of the forms it joins together so that when the aggregate is poured, said aggregate overlies top edge 17 of said second sidewall 16; thus, when channel 11 is removed upon curing of the aggregate, the small indentation formed therein by the second sidewall is usually covered by the abutting turf and is therefore not visible.

Figure 4:
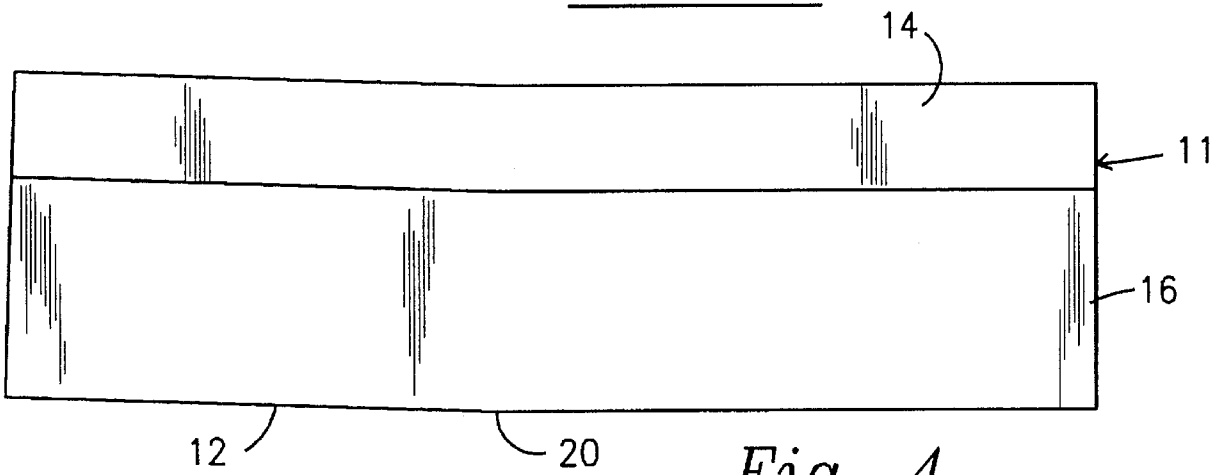
FIG. 4 is a front elevational view of a second embodiment, disclosing a linear channel having a ramp formed therein.

In a second embodiment, depicted in FIG. 4, a transverse bend 20 is formed coincident with a transverse axis of bottom wall 12 to facilitate construction of a wheelchair ramp. The maximum angle of inclination required by current law for a wheelchair ramp is five degrees. The angle of bend may be positive to form the bottom of a ramp as depicted in FIG. 4, or it may be negative to form the top of a ramp.

Figure 5:
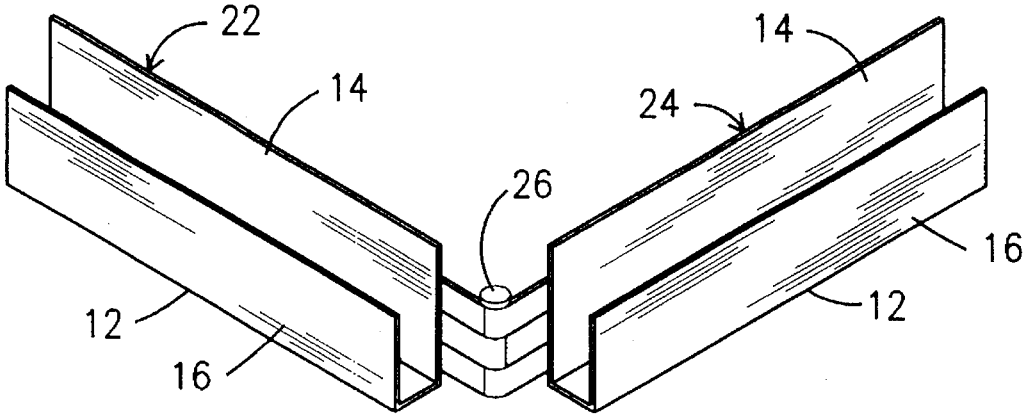
FIG. 5 is a perspective view of an embodiment having hingedly interconnected channels.

FIG. 5 depicts a pair of channel members, generally denoted 22 and 24, that are interconnected at their respective first sidewalls by a hinge means 26. This facilitates the construction of inside and outside corners of differing angles.

Figure 6:
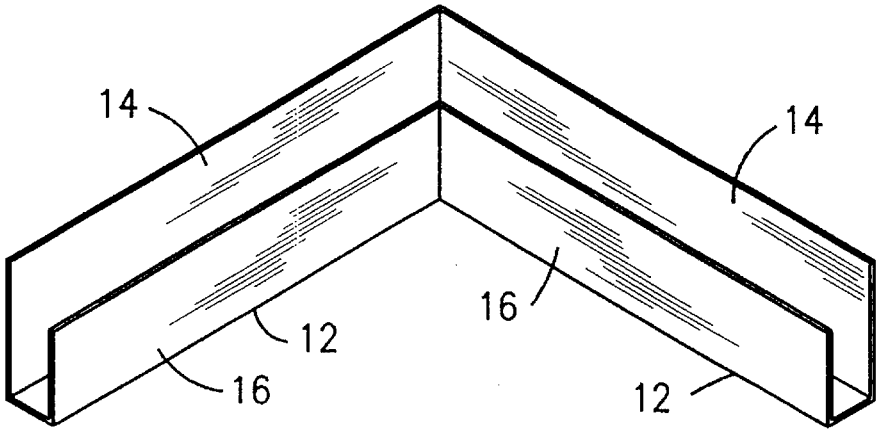
FIG. 6 is a perspective view of a channel for forming outside corners.
Figure 7:
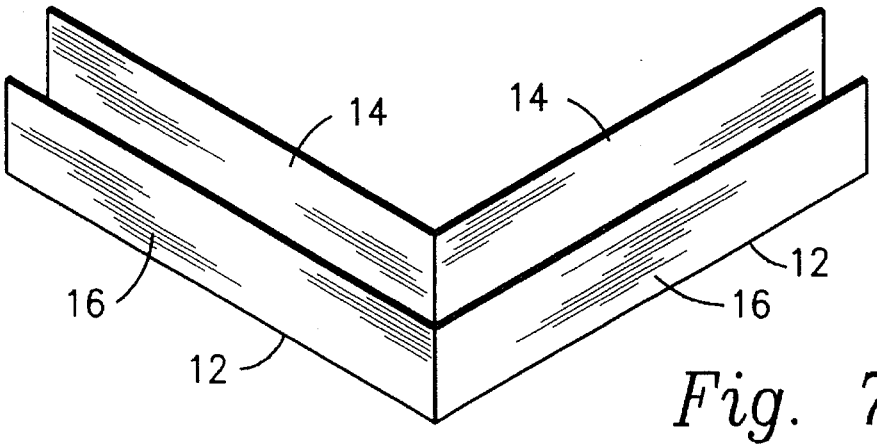
FIG. 7 is a perspective view of a channel for forming inside corners.

FIGS. 6 and 7 disclose additional embodiments that include a pair of channel members. The FIG. 6 embodiment is employed in the construction of outside corners; note that first sidewall 14 is positioned on the outside of the walk to be poured. Its greater height and concomitant greater strength serve to prevent outward bowing of the forms. In the FIG. 7 embodiment, used for inside corners, the first sidewall 14 is again on the outside for the same reason.

Figure 8:
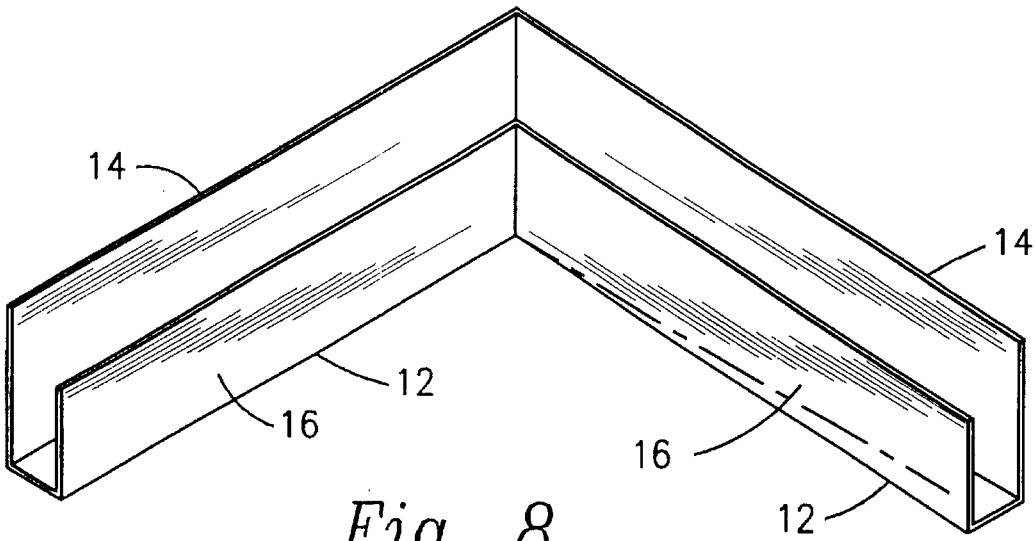
FIG. 8 is a perspective view of a channel similar to the FIG. 6 channel, but including a ramp formed therein.
Figure 9:
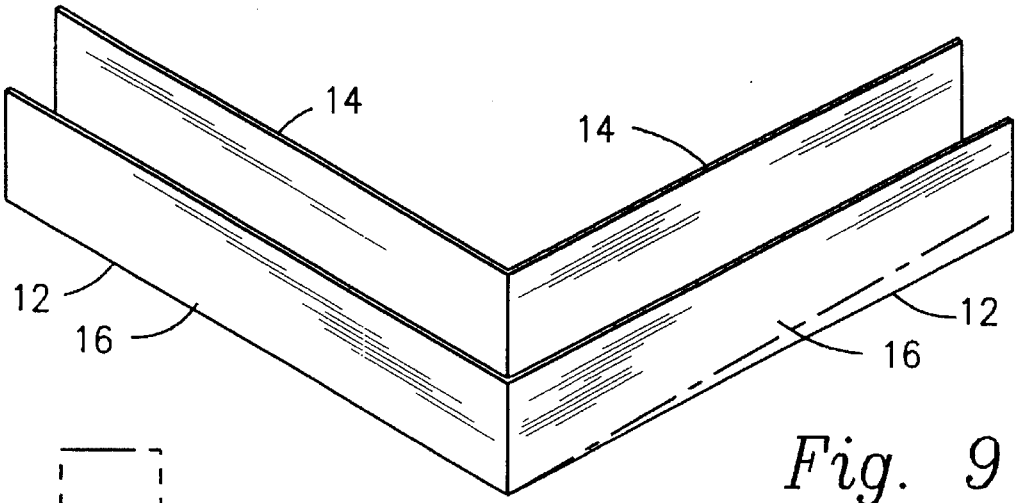
FIG. 9 is a perspective view of a channel similar to the FIG. 7 channel, but including a ramp formed therein.

Note further that the channels of the embodiments of FIGS. 5 and 7 can be angled with respect to one another to facilitate wheelchair ramp construction. Such ramped channels are depicted in FIGS. 8 and 9.

Figure 10:
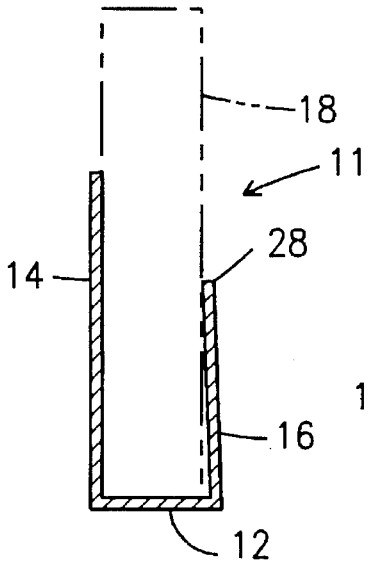
FIG. 10 is a transverse sectional view depicting an embodiment of the channels where the sidewalls are obliquely disposed with respect to one another.

In the embodiments of FIGS. 2–9, the first and second sidewalls are disposed in parallelism to one another. Accordingly, the inner surface of each sidewall abuts the surface of any form positioned therewithin. However, in all embodiments, second sidewall 16 may be disposed obliquely with respect to first sidewall 14. In FIG. 10, the top edge of second sidewall 16 abuts a form along an elongate line of contact denoted 28; this reduces the friction between said second sidewall and said form and thus reduces the effort required to slide the form into and out of the channel. Importantly, the channels of all embodiments may be provided with such oblique second sidewall.

Figure 11:
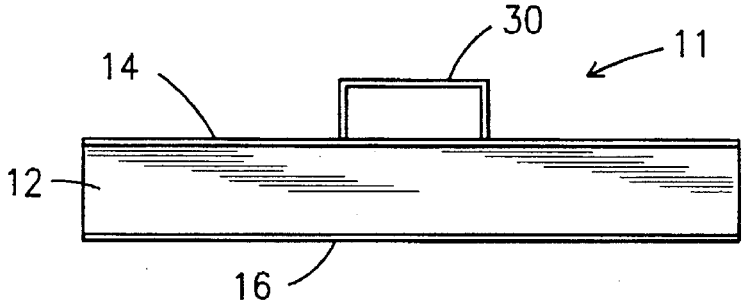
FIG. 11 is a top plan view of an embodiment including a stake-receiving bracket.

One or more stake-receiving brackets such as bracket 30 may be welded or otherwise attached to each first sidewall 14 anywhere along its extent as depicted in FIG. 11.

Figure 12:
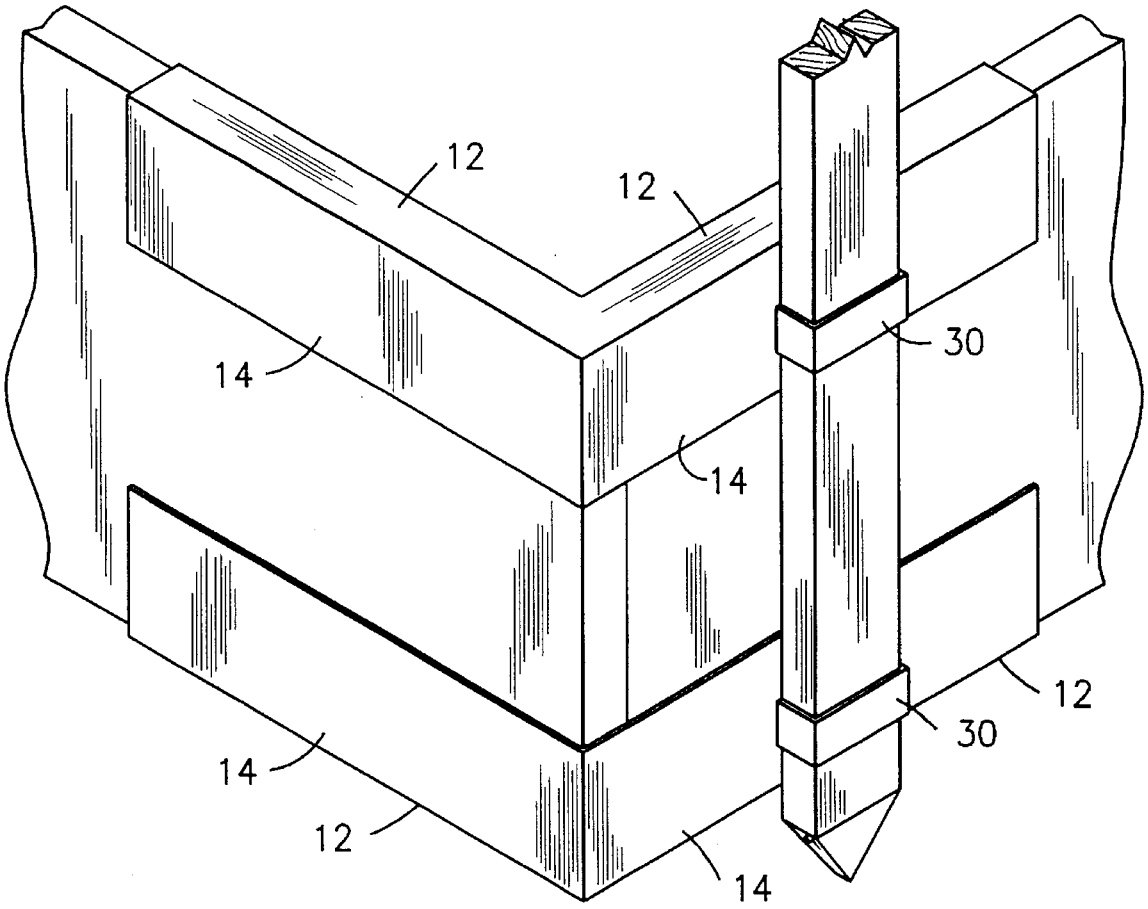
FIG. 12 is a perspective view of an embodiment employing upper and lower channels where the forms have a height that requires said upper and lower channels to provide additional strength.

Some applications require forms having extended heights and in such applications plywood 19 (FIG. 12) is often used. The plywood is often quite thin and thus requires reinforcement; FIG. 12 shows how a pair of the novel channels can be used advantageously in such applications. Note that a first and a second channel member of the type equipped with brackets 30 are disposed on the top and bottom edges, respectively, of plywood form 19 and are interconnected by a stake to provide the needed strength.

Figure 13:
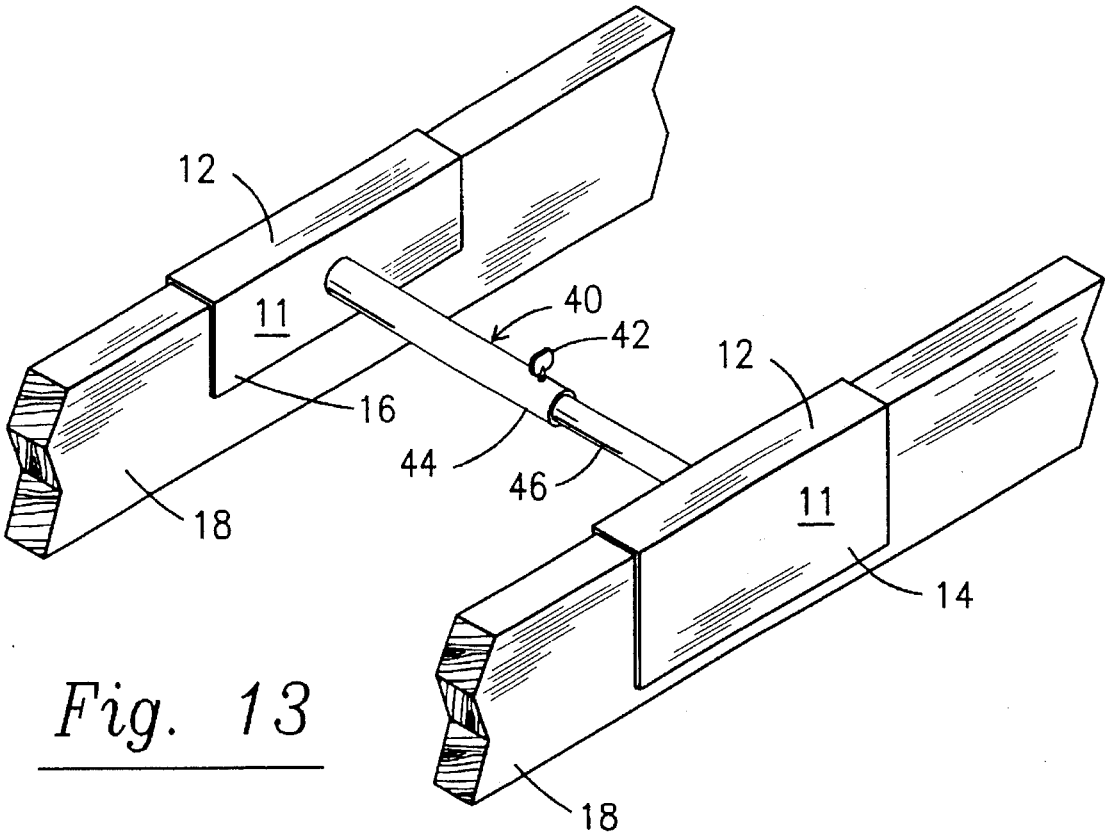
FIG. 13 is a perspective view of an embodiment that includes a telescoping interconnecting member for positioning parallel forms in fixed relation to one another to facilitate the construction of structures having a uniform width.

The embodiment of FIG. 13 includes a telescoping member 40 having a set screw 42 or other suitable locking means for locking telescoping rods 44, 46 into a predetermined relation to one another to thereby fix the transverse spacing between parallel channels 11, 11. Thus, after the channel members 11, 11 have been spaced four feet apart, for example, and such distance is locked in by locking means 42, the splicers 11, 11 can be moved and reused as needed without further measurement to ensure construction of a sidewalk or other structure having a uniform width along its extent.

Figure 14:
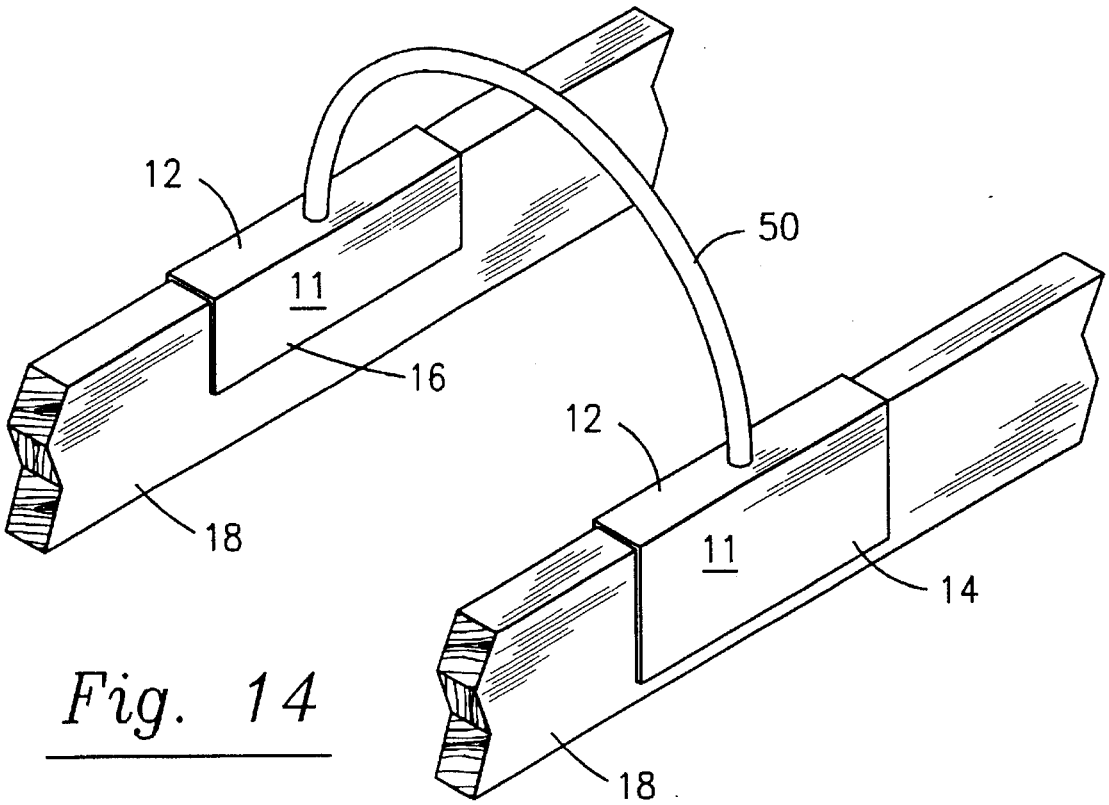
FIG. 14 is a perspective view of an embodiment that includes a nontelescoping interconnecting member for positioning parallel forms in fixed relation to one another.

The structure of FIG. 14 is similar to that of FIG. 13 except that the transverse spacing between parallel channels 11, 11 is fixed. A rebar 50, or other suitable rod, is bent into a predetermined curvature to space the channels into a fixed relation to one another. This arrangement is believed to be most suitable for the construction of curbs or other applications where the channels are relatively closely spaced apart from one another.

Figure 15:
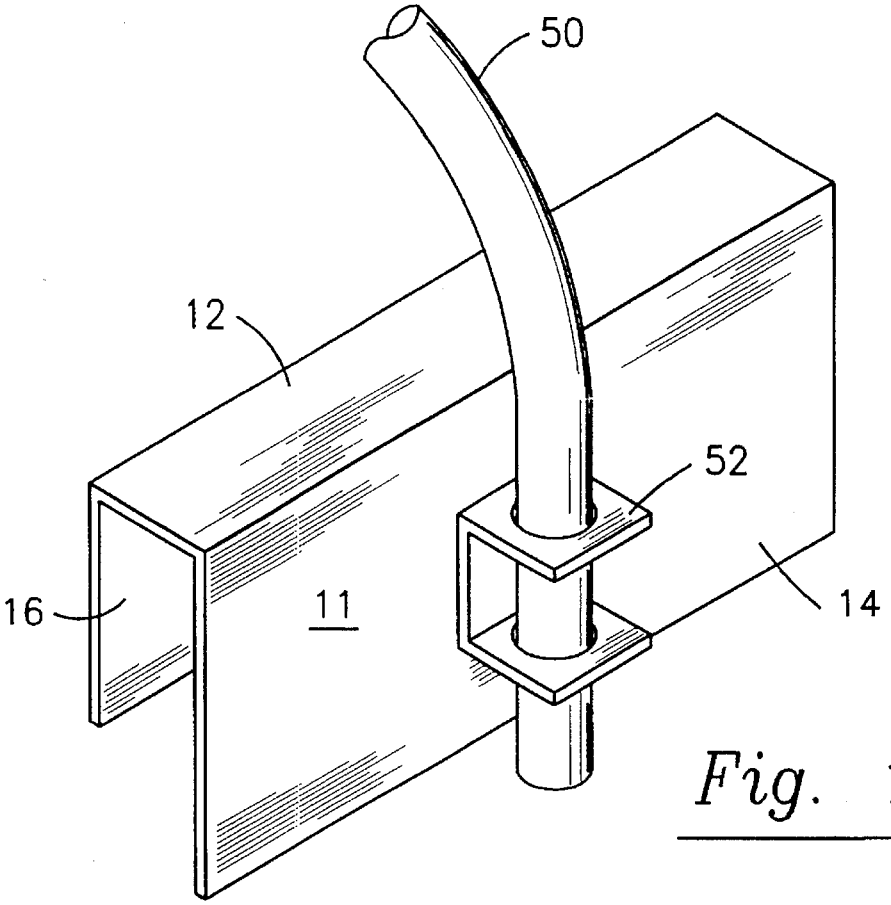
FIG. 15 is a perspective view of an embodiment similar to the embodiment of FIG. 14, showing a means for bending the interconnecting means into its desired radius of curvature.

FIG. 15 shows a variation of the channels of FIG. 14. A bracket 52 having centrally apertured double ears is secured to wall 14 to enable bending of a rebar or other rod 50 as depicted. This facilitates bending of such rod 50.

Figure 16:
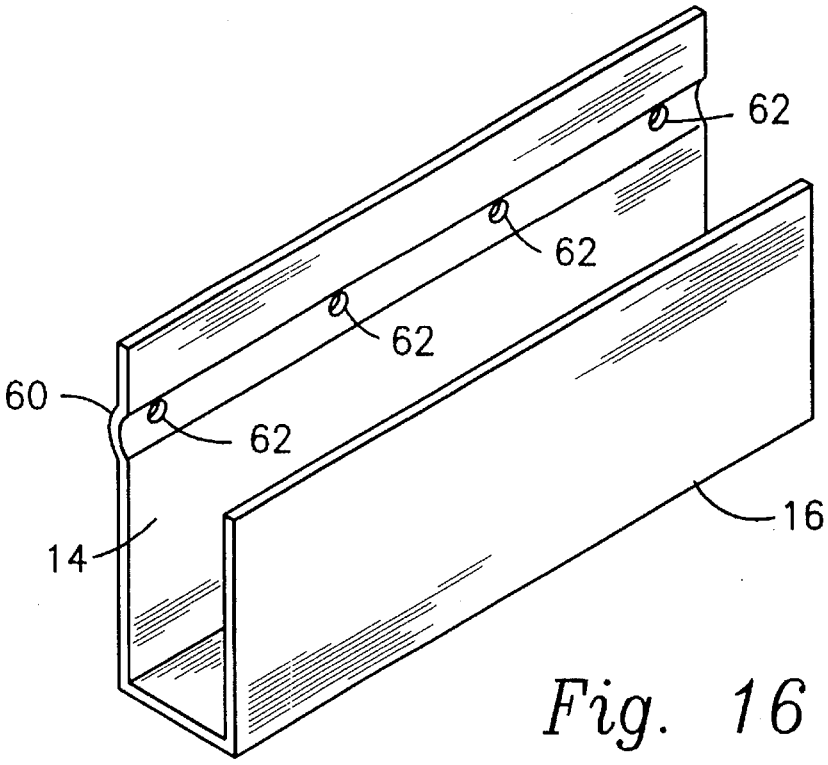
FIG. 16 is a perspective view of a channel member having an elongate strengthening rib formed therein.

FIG. 16 depicts a channel having an elongate strengthening rib 60 formed in wall 14.

Time studies have revealed that a work crew using the novel channels can set up the forms required to frame an area to be covered with concrete or other aggregate in about half the time as crews using scabs to interconnect the forms. Similarly, work crews disassembling the forms after the aggregate has cured can complete the work in about half the time required to remove the scabs. Moreover, the forms last much longer because scabs are not repeatedly nailed thereto, and their ends are not damaged and thus never require cutting off. Of course, scabs are eliminated in their entirety. Light weight wooden forms may be employed in lieu of heavy metallic forms, and such wooden forms may be cut to any length desired. Curved sidewalk construction is also made easier by the novel channels because wooden forms are easily curved when their opposite ends are held in the novel channels. The devices depicted and described herein further facilitate the construction of sidewalks and similar structures of uniform width, provide strengthening means for relatively thin forms of extended height that require reinforcement, and provide brackets for receiving stakes to further reinforce such forms.

This invention is clearly new and useful. Moreover, it was not obvious to those of ordinary skill in this art at the time it was made, in view of the prior art considered as a whole as required by law.

It will thus be seen that the objects set forth above, and those made apparent from the foregoing description, are efficiently attained and since certain changes may be made in the above construction without departing from the scope of the invention, it is intended that all matters contained in the foregoing construction or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

Now that the invention has been described,

What is claimed is:

1. A device for joining forms used in aggregate construction, comprising:

a channel member having an elongate, flat bottom wall and a pair of sidewalls mounted to opposite longitudinal edges of said flat bottom wall along the extent thereof in generally upstanding relation thereto;

said channel member having a linear configuration;

said pair of sidewalls including a first sidewall and a second sidewall;

said first sidewall having a first height and said second sidewall having a second height, said first height being greater than said second height;

said flat bottom wall having a transverse extent slightly greater than a transverse extent of a form;

said second sidewall being disposed at a predetermined angle in converging relation to said first sidewall, said second sidewall having a top edge adated to abut forms positioned within said channel member along a longitudinally-extending line of contact, said predetermined angle being selected to space said top edge apart from said first sidewall by a distance substantially equal to a thickness of a form, said top edge only of said second side wall adapted to abut said form;

said channel member having a length sufficient to receive therein abutting ends of a pair of forms disposed in end-to-end abutting relation to one another, said length being sufficient to align said pair of forms in axial alignment with one another;

said channel member being removable and reusable after said aggregate has hardened.

2. A device for joining forms used in aggregate construction, comprising:

a channel member having a flat bottom wall and a pair of sidewalls mounted to opposite longitudinal edges of said flat bottom wall along the extent thereof in generally upstanding relation thereto;

said channel member having a linear configuration;

said flat bottom wall having a bend formed therein, said bend being formed along a transverse axis of said flat bottom wall;

said pair of sidewalls including a first sidewall and a second sidewall;

said first sidewall having a first height and said second sidewall having a second height, said first height being greater than said second height;

said flat bottom wall having a transverse extent substantially equal to a transverse extent of a form;

said channel member having a length sufficient to receive therein abutting ends of a pair of forms disposed in end-to-end relation to one another, said length being sufficient to align said pair of forms in axial alignment with one another;

said bend being approximately five degrees.

3. A device for joining forms used in aggregate construction in fixed angular relation to one another, comprising:

a first channel member having an elongate, flat bottom wall and a pair of sidewalls mounted to opposite longitudinal edges of said flat bottom wall along the extent thereof in generally upstanding relation thereto;

said first channel member having a linear configuration;

said pair of sidewalls including a first sidewall and a second sidewall;

said first sidewall having a first height and said second sidewall having a second height, said first height being greater than said second height;

said flat bottom wall having a transverse extent substantially equal to a transverse extent of a concrete form;

said first channel member having a length sufficient to receive therein an end of a first form of a pair of forms, said length being sufficient to align said first form in axial alignment with said first channel member;

a second channel member having an elongate, flat bottom wall and a pair of sidewalls mounted to opposite longitudinal edges of said second channel member flat bottom wall along the extent thereof in generally upstanding relation thereto;

said second channel member having a linear configuration;

said pair of sidewalls of said second channel member including a first sidewall and a second sidewall;

said first sidewall of said second channel member having a first height and said second sidewall of said second channel member having a second height, said first height of said second channel member first sidewall being greater than said second height of said second channel member second sidewall;

said flat bottom wall of said second channel member having a transverse extent substantially equal to a transverse extent of a form;

said second channel member having a length sufficient to receive therein a second form of said pair of forms, said length of said second channel member being sufficient to align said second form in axial alignment with said second channel member;

said first channel member and said second channel member being disposed at a substantially right angle to one another;

said first sidewall of said first channel member and said first sidewall of said second channel member being integrally formed with one another and said second sidewall of said first channel member and said second sidewall of said second channel member being integrally formed with one another;

said first channel member and said second channel member being open on respective outer ends thereof and being closed on respective inner ends thereof so that respective inner ends of forms disposed within said first and second channel members are constrained to fit within said device in abutting relation to one another;

said flat bottom wall of said first channel member being disposed at a predetermined angle with respect to said flat bottom wall of said second channel member, said predetermined angle being about five degrees.

4. A device for joining forms used in aggregate construction, comprising a first channel member having a first stake-receiving bracket, a second channel member having a second stake-receiving bracket, and wherein said first channel member and said second channel member are placed at opposite top and bottom edges of a form having a height and a thickness that requires strengthening, so that a stake may be received through said brackets of said first channel member and said second channel member.

5. A device for joining forms used in aggregate construction, comprising:

a first channel member having an elongate, flat bottom wall and a pair of sidewalls mounted to opposite longitudinal edges of said flat bottom wall along the extent thereof in generally upstanding relation thereto;

said first channel member having a linear configuration;

said pair of sidewalls including a first sidewall and a second sidewall;

said first sidewall having a first height and said second sidewall having a second height, said first height being greater than said second height;

said flat bottom wall having a transverse extent substantially equal to a transverse extent of a form;

said first channel member having a length sufficient to receive therein abutting ends of a pair of forms disposed in end-to-end relation to one another, said length being sufficient to align said pair of forms in axial alignment with one another;

a second channel member having a construction the same as said first channel member;

said second channel member disposed in transversely spaced apart, parallel relation to said first channel member;

said first channel member and said second channel members being positioned atop a top edge of their associated forms;

a rod member disposed in interconnecting relation to said first channel member and said second channel member;

said rod member having a predetermined bend formed therein for spacing said first and second channel members in fixed transversely spaced apart relation to one another so that further measurements need not be taken after said rod member has been bent.

* * * * *